United States Patent [19]

Fox

[11] 4,065,814

[45] Jan. 3, 1978

[54] ONE PIECE ELASTIC BODY SUIT

[76] Inventor: Edgar N. Fox, 2301 H St., NE., #132, Washington, D.C. 20002

[21] Appl. No.: 717,214

[22] Filed: Aug. 24, 1976

[51] Int. Cl.[2] ..... A41D 13/02

[52] U.S. Cl. ..... 2/79; 2/227; 128/80 G; 272/139

[58] Field of Search ..... 2/79, 80, 2.1 A, 2, 2/227, 229, 233; 272/139, 119, 72; 128/80 G, 25 R, 24

[56] References Cited

U.S. PATENT DOCUMENTS

| | | | |
|---|---|---|---|
| 908,889 | 1/1909 | Sargh | 2/233 |
| 1,337,901 | 4/1920 | Godward | 2/233 |
| 1,663,641 | 3/1928 | Smallwood | 272/139 |
| 2,097,376 | 10/1937 | Marshman | 272/139 |
| 2,431,811 | 12/1947 | Lang | 2/79 X |
| 2,568,304 | 9/1951 | Schoenbrun | 2/80 X |
| 3,295,517 | 1/1967 | Stevens | 128/80 G |

FOREIGN PATENT DOCUMENTS

| | | | |
|---|---|---|---|
| 1,144,344 | 4/1957 | France | 2/79 |
| 349,095 | 5/1931 | United Kingdom | 2/79 |

*Primary Examiner*—H. Hampton Hunter
*Attorney, Agent, or Firm*—Burns, Doane, Swecker & Mathis

[57] ABSTRACT

A one piece elastic body suit worn by a person to coordinate and tone the body includes an outer and an inner layer joined together, wherein each layer has a shirt and trouser section. A plurality of elastic band members are disposed between the inner and outer layers of the suit.

4 Claims, 4 Drawing Figures

ONE PIECE ELASTIC BODY SUIT

BACKGROUND OF THE INVENTION

A number of U.S. Patents relate to variously designed devices for toning the human body, but these patents are nonapplicable to my present invention. These patents are U.S. Pat. Nos. 650,656 to Raabe; 1,618,273 to Davidson; 2,097,376 to Marshman; and 3,411,500 to Gatts.

SUMMARY OF THE INVENTION

My present invention relates to a unique and special one piece elastic body suit for toning a user's body.

An object of my present invention is to provide a one piece elastic body toning suit designed to tone and strengthen the body movement and coordination of a person by the application of a positive pressure to the legs, back and shoulder of the person.

Briefly, my present invention comprises a one piece elastic body toning suit having an outer and inner cloth layer which are joined together. The suit has a shirt and trouser section. A plurality of elastic band members are disposed between the inner and outer layers of the suit.

BRIEF DESCRIPTION OF THE DRAWINGS

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 1:
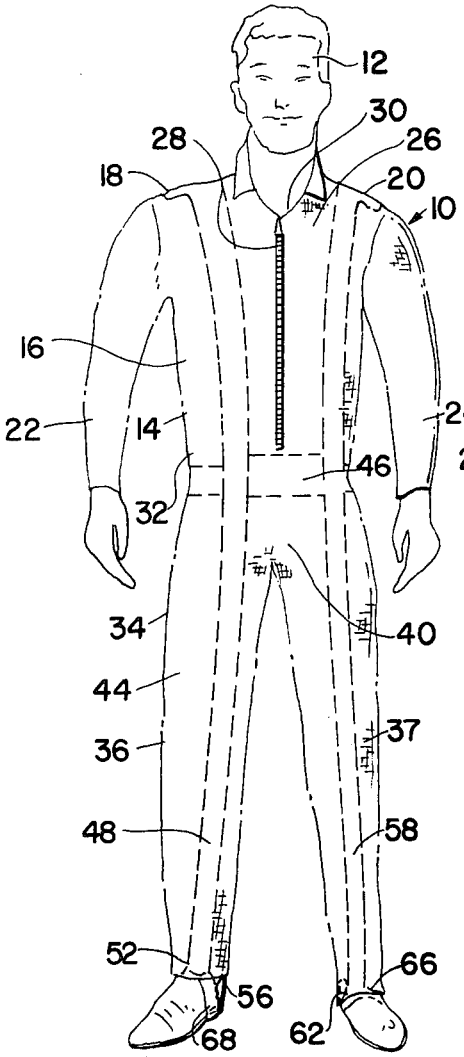
FIG. 1 illustrates a front elevational view of a body toning suit.
Figure 2:
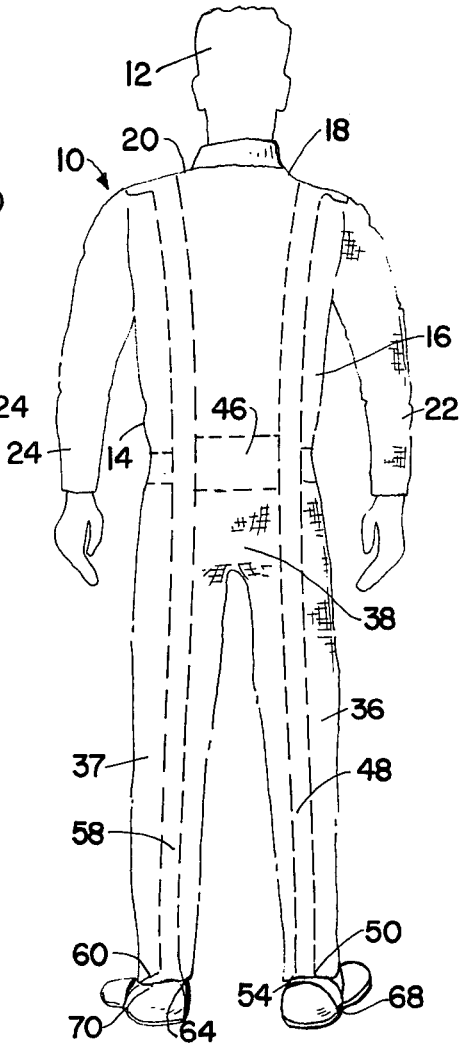
FIG. 2 illustrates a rear elevational view of the body toning suit.
Figure 3:
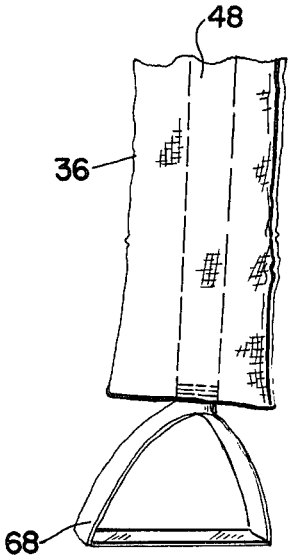
FIG. 3 illustrates a front view of a foot engaging means of the suit.
Figure 4:
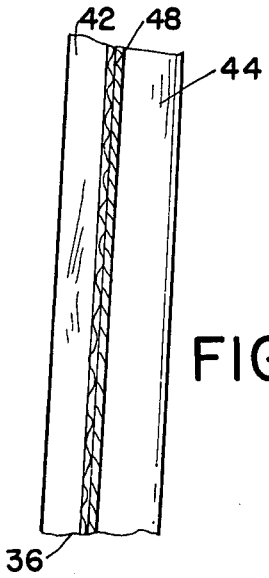
FIG. 4 illustrates a side cross sectional view of a leg portion of the suit.

Turning now descriptively to the drawings, in which similar reference characters denote similar elements throughout the several views, FIGS. 1–2 and 4 show a one piece elastic body toning suit 10 adapted to tone and strengthen the body movement and coordination of a person 12 by the application of a positive pressure to the legs, back and shoulders of the person. The suit 10 generally comprises a shirt section 14 having a body portion 16, a pair of shoulder portions 18, 20, and a pair of arm portions 22, 24, wherein the front 26 of the body portion 16 has a zipper assembly 28 disposed therein. The zipper assembly 28 extends downwardly from the neck 30 to the waist portion 32 of the shirt section 14. The trouser section 34 of the suit 10 comprises a pair of open ended leg portions 36, 37, a rear seat section 38 and a front upper portion 40. The shirt 14 and trouser 34 sections are formed from a conventional outer fabric layer 42 such as cotton, nylon, polyester or acrylic. The inner fabric layer 44 of the sections 14, 34 is generally formed from cotton, wherein the layers 42, 44 are joined together by conventional sticking means. A waist elastic band member 46 is secured in place between the two layers 42, 44, wherein band member 46 stretches around the entire periphery of the waist portion 32 of the shirt section 14. A first elongated elastic band member 48 is disposed between layers 42, 44, wherein one end 50 of band member 48 is affixed to a lower rear end 54 of a first leg portion 36 and the other end 52 of band member 48 is affixed to a lower front end 56 of the first leg portion 36. The band members 48 extends upwardly through the back of the suit 10, over the first shoulder portion 18, and downwardly through the front of the suit 10, wherein the band member 48 is affixed to a rear and a front of band member 46. A second elongated elastic band member 58 is disposed between layers 42, 44, wherein one end 60 of band member 58 is affixed to a lower rear end 64 of a second leg portion 37 and the other end 62 of band member 58 is affixed to a lower front end 66 of the second leg portion 37. The band member 58 extends upwardly through the back of the suit 10, over the second shoulder portion 20, and downwardly through the front of the suit 10, wherein the band member 58 is affixed to a rear and front of band member 46. A first triangularly shaped elastic strap member 68 as shown in FIGS. 1, 2, 3 is affixed to the ends 50, 52 of the elastic band member 48, wherein strap member 68 extends downwardly below leg portion 36 and is adapted to receive one of the feet of the user therein. A second triangularly shaped elastic strap member 70 is affixed to the ends 60, 62 of band member 58, wherein strap member 70 extends downwardly below leg portion 37 and is adapted to receive the other foot of the user. When the suit 10 is worn, band members 58, 48 are placed under tension by the downwardly pulling exerted by the feet of the user on strap member 68, 70 thereby exerting pressure on the muscles of the body.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A one piece elastic body toning suit adapted to be worn by a person for toning the body of said person, which comprises:

a. an outer cloth-like layer having a shirt section and a trouser section, and shirt section having a waist band portion, a front, a back, a pair of shoulder portions, and a pair of arm portions, said trouser section having an upper front portion, a rear seat portion, and a pair of leg portions;

b. said shirt section and said trouser section having an inner cloth-like layer, said inner cloth-like layer secured to said outer cloth-like layer;

c. a plurality of elastic band members disposed between said outer and said inner layers, including:

an elastic waist band member extending around said waist portion of said suit;

a first elongated elastic band member, disposed between said inner and outer layers and attached to said waist band member, said first band member having a first end adapted for engagement by one foot of the wearer, having a central portion passing over a first shoulder portion of the shirt section, and having a second end adapted for engagement by the foot of the wearer so that, when the suit is worn by the wearer, said first band member is disposed adjacent the front and rear of one leg of the wearer; and, a second elongated elastic band member, disposed between said inner and outer layers and attached to said waist band members, said second band member having a first end adapted for engagement by the other foot of the wearer, having a central portion passing over a second shoulder portion of the shirt section, and having a second end adapted for engagement by the other foot of the wearer so that, when the suit is worn by the wearer, said second band member is disposed adjacent the front and rear of the other leg of the wearer, whereby when a leg of the wearer is bent, a front portion of the elastic member adjacent the leg is stretched.

2. A suit according to claim 1, further comprising a pair of triangularly shaped elastic strap mmebers, one said strap member affixed to said ends of each of said elongated band member, each said triangularly shaped strap member extending downwardly from each said leg portion.

3. A suit according to claim 1, further comprising a zipper disposed in said front of said shirt section.

4. An elastic body toning garment including:

an outer fabric trouser section;

an inner fabric trouser section secured to said outer section to form a one-piece garment;

an elastic waist band member disposed between the inner and outer trouser section extending around a waist portion of the trouser sections and secured thereto;

a front elastic band member disposed between the inner and outer trouser sections which front band member is attached to the waist band member and extends downwardly along the front of a leg of the trouser sections;

a rear elastic band member which rear band member is attached to the waist band member and extends downwardly along the rear of the leg of the trouser sections; and a stirrup member, for engaging the foot of the wearer, attached to lower ends of the front and rear elastic band members.

* * * * *